US005582527A

United States Patent [19]

Nakamura

[11] Patent Number: 5,582,527

[45] Date of Patent: Dec. 10, 1996

[54] STEERING SYSTEM FOR OUTBOARD MOTOR

[75] Inventor: Daisuke Nakamura, Hamamatsu, Japan

[73] Assignee: Sanshin Kogyo Kabushiki Kaisha, Hamamatsu, Japan

[21] Appl. No.: 365,691

[22] Filed: Dec. 29, 1994

[30] Foreign Application Priority Data

Dec. 30, 1993 [JP] Japan ..... 5-354051

[51] Int. Cl.[6] ..... B63H 25/52

[52] U.S. Cl. ..... 440/55; 114/172

[58] Field of Search ..... 114/170, 172; 440/55, 56

[56] References Cited

U.S. PATENT DOCUMENTS 3,310,021 3/1967 Shimanckas .
4,521,201 6/1985 Watanabe ..... 440/55

FOREIGN PATENT DOCUMENTS 50-100299 8/1975 Japan .
53-3597 1/1978 Japan .
4722693 5/1978 Japan .
56-59500 5/1981 Japan .

*Primary Examiner*—Sherman Basinger
*Attorney, Agent, or Firm*—Knobbe, Martens, Olson & Bear

[57] ABSTRACT

A steering device for an outboard motor that retains the motor under constant, although adjustable, pressure to releasably hold it in a plurality of secured positions. Moreover, the releasable restraining device permits rotation of the motor about the tilt and trim axis while the retaining device is in any of a plurality of retained positions.

7 Claims, 7 Drawing Sheets

STEERING SYSTEM FOR OUTBOARD MOTOR

BACKGROUND OF THE INVENTION

This invention relates to a steering device for an outboard motor and, more particularly, to an adjustable restraining device for retaining the motor in one of a plurality of fixed steering conditions while permitting pivotal movement of the motor about a tilt and trim axis.

As is well known, outboard-motors normally include a swivel bracket which not only supports the power head and drive unit for steering movement about a generally vertically extending steering axis, but also facilitates tilting movement about a generally horizontally extending tilt and trim axis. The tilting movement relative to the transom of the boat is often required with some outboard motors to angularly adjust the power unit to place the propeller at an optimum position for boat propulsion. Normally, a handle or tiller is affixed to the power unit for steering movement about the steering axis.

In many instances it is desirable to provide an arrangement for retaining the steered components in a set position so that the operator is not required to continually have his hand on the tiller. For example, when the operator is trolling for fish, he or she may wish to keep both hands free to fish while the boat travels in a straight-ahead direction or while the boat circles a particular region of water. Similarly, when traveling in a straight line across a current, it is necessary to position the motor to steer slightly into the current to compensate for the forces of the current that tend to turn or propel the boat in an undesired direction. Thus, it is often desired to have a retaining device that is capable of retaining the steered components in a plurality of different conditions such as in a position to steer the boat in a straight ahead, as well as in a left-and/or right-turning direction.

Various retaining devices have been developed to meet some of these requirements. One such device is disclosed in U.S. Pat. No. 4,521,201 to Watanabe. This retaining mechanism, however, is limited to retaining the motor in only one predetermined position so that the boat will travel in, for example, a straight-ahead direction. Such an arrangement, however, is not capable of retaining the motor in a plurality of other positions such as in a right- or left-turning direction.

Another retaining device is disclosed in U.S. Pat. No. 2,846,896 to Allen. Although this retaining device is capable of holding the steering components in a plurality of positions, it requires securing the tiller to the transom and does not permit tilting movement of the swivel bracket while in a retained position. Thus, the operator must disconnect the retaining device in order to tilt or adjust the motor to its optimum position for boat propulsion.

It is, therefore, a principal object of this invention to provide an improved steering system for an outboard motor or the like.

It is another object of this invention to provide an outboard motor steering system wherein the motor may be restrained in any of a plurality of predetermined steering conditions.

It is another object of this invention to provide an improved outboard motor steering arrangement wherein the motor may be tilted about a horizontal tilt axis while still in one of a plurality of restrained positions.

It is another object of this invention to provide an improved outboard motor steering system wherein the motor may be restrained under constant, although adjustable, pressure to hold it in a plurality of secured positions, but facilitates tilting and readjustment of the motor about a horizontal tilt axis and a vertical steering axis.

It is another object of this invention to provide an improved outboard motor steering arrangement comprising a releasable retaining device capable of manually locking the motor in a secured or retained position.

It is another object of this invention to provide an improved outboard motor steering arrangement comprising a detachable retaining device that is removably mounted to a clamping bracket assembly. Other and more detailed objects and advantages of the present invention will be apparent to those skilled in the art from the following description and the accompanying drawings.

SUMMARY OF THE INVENTION

A first feature of this invention is adapted to be embodied in a steering device for an outboard motor or the like comprising a first member that is adapted to be affixed to a vessel and a second member journalled for steering movement about a steering axis and pivotal movement about a tilt axis relative to said first member. In accordance with this feature of the invention, a restraining mechanism restrains the second member against steering movement relative to the first member, but permits pivotal movement of the second member about the tilt axis. The restraining mechanism comprises a pair of interengaging locking elements cooperating to allow one element to rotate about the steering axis and the other element to rotate about the tilt axis.

Another feature of the invention is also adapted to be embodied in a steering device having a first member, and a second member that is journalled for steering movement relative to the first member. In accordance with this feature of the invention, a restraining mechanism is provided for holding the second member against steering movement relative to the first member in a plurality of steering orientations. The restraining mechanism comprises a pair of interengaging locking elements that frictionally cooperate to prevent steering movement of the second member relative to the first member.

DETAILED DESCRIPTION OF THE PREFERRED EMBODIMENT OF THE INVENTION

Figure 1:
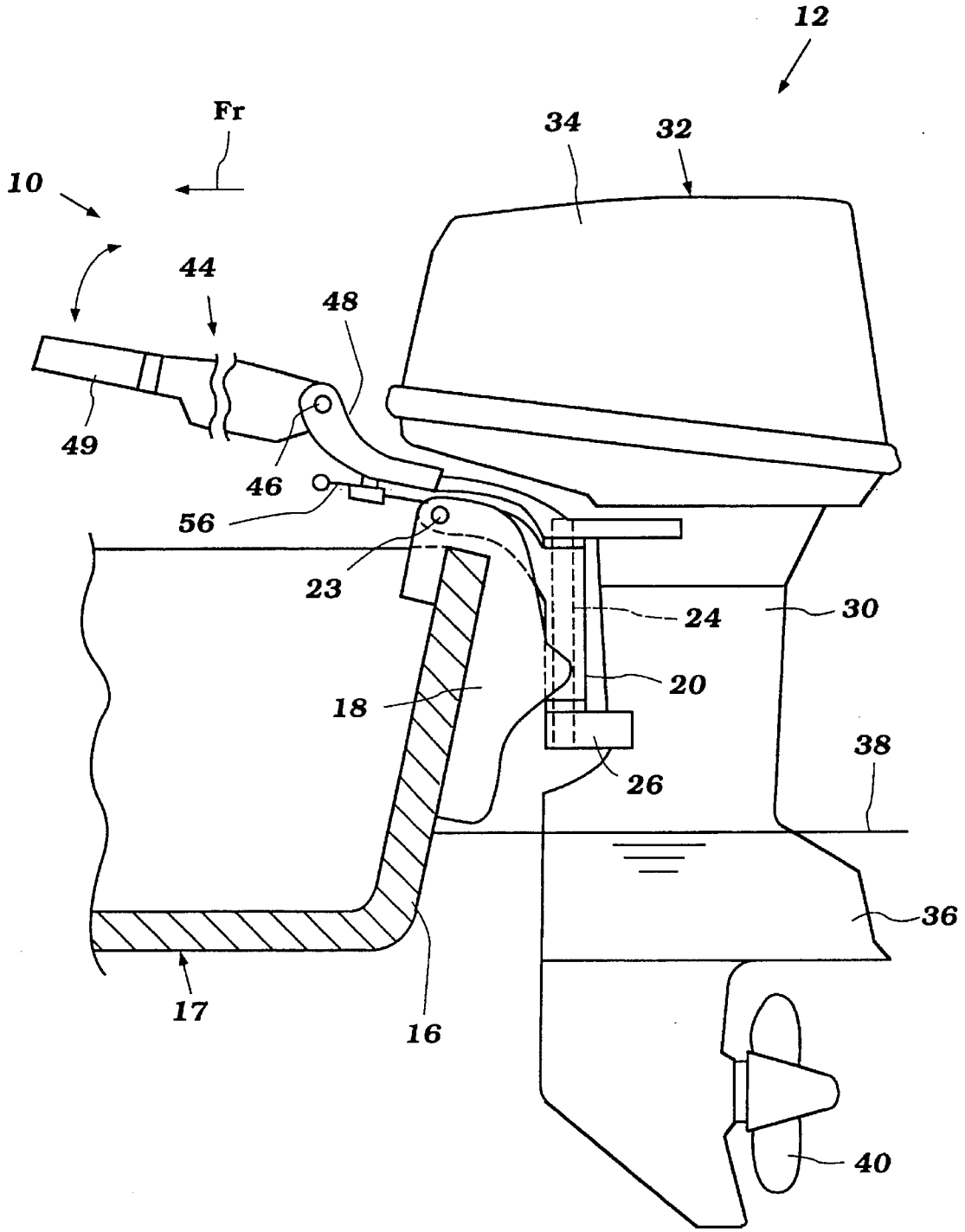
FIG. 1 is a side elevational view of an outboard motor constructed in accordance with an embodiment of this invention.
Figure 2:
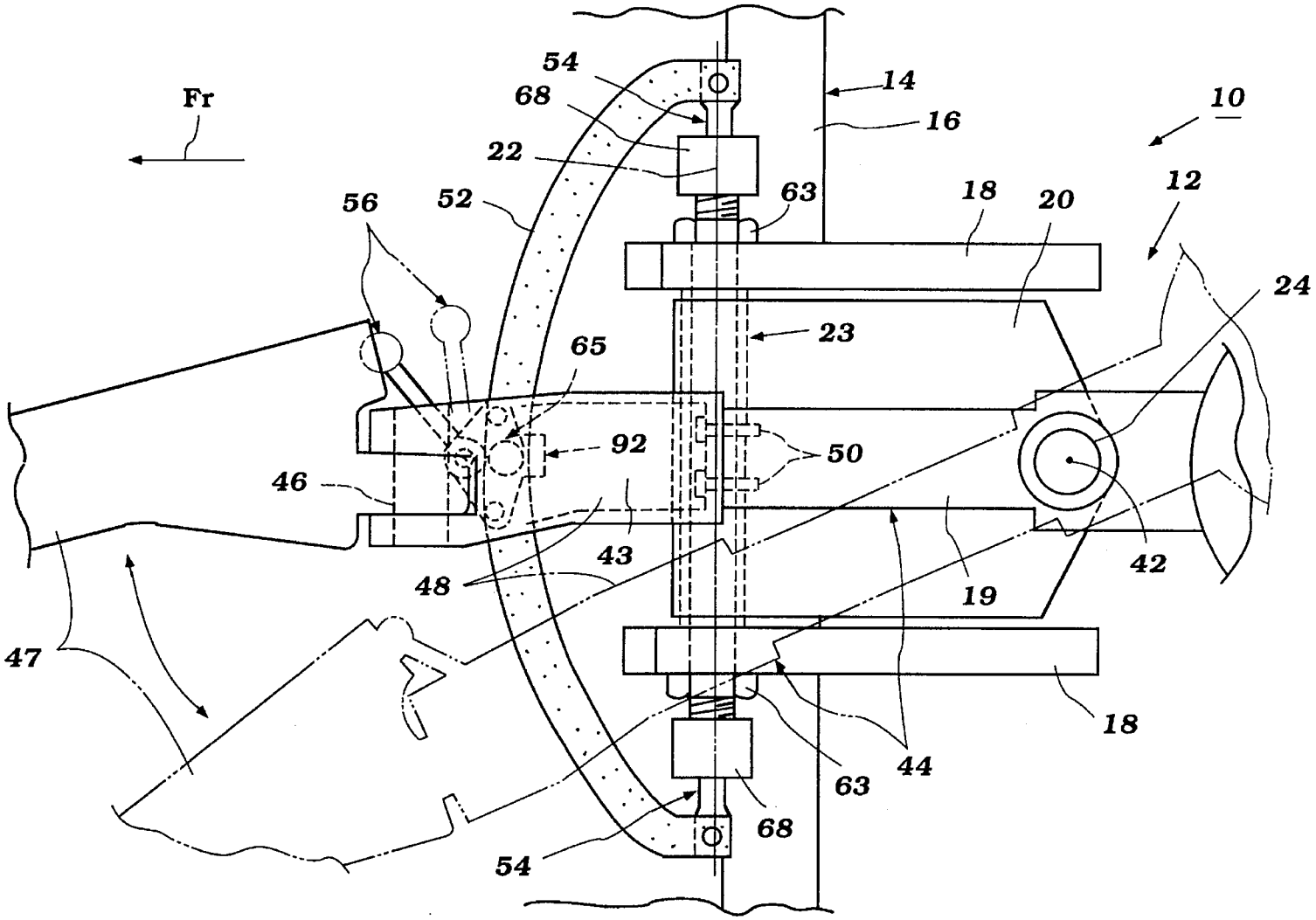
FIG. 2 is a top plan view of the restraining mechanism constructed in accordance with an embodiment of this invention.

Turning in detail to FIGS. 1 and 2, a boat 10 and an outboard motor 12 are shown having a steering arrangement constructed in accordance with an embodiment of the invention. The motor 12 is adapted to be affixed to the stern 14 of the boat 10, and particularly to the boat transom 16. For this purpose, a clamping bracket assembly 18 is provided to affix the motor 12 to the transom 16 in a known manner. A swivel bracket 20 is supported upon the clamping bracket 18 for pivotal movement about a substantially horizontally extending tilt and trim axis 22.

The swivel bracket 20 journals a steering shaft 24 of the motor 12 in a known manner. This arrangement includes a steering bracket 26 to which a drive shaft housing 30 of the motor 12 is affixed in a known manner. The upper end of the drive shaft housing 30 carries a power head 32 that consists of an outer cowling 34 and internal combustion engine. Depending from the drive shaft housing 30 is a lower unit 36 positioned below the waterline 38 in which a propeller 40 is journalled.

The steering shaft 24, and, accordingly, power head 32, drive shaft housing 30, and lower unit 36 are rotated for steering movement about a generally vertically extending steering axis 42, defined by a centerline drawn through the steering shaft 24, by means of a tiller 44. The tiller 44 consists of a generally forwardly extending handle 47 pivotally mounted about a bolt 46 to a generally upwardly arc-shaped member 48 which forms the base portion of the tiller 44. The member 48 contains a blocking member 43 to prevent downward vertical pivoting of the handle 47 and is affixed to an upper extending portion 19 of the swivel bracket 20 by a pair of bolts 50.

The construction of the motor 12 as thus far described is conventional. For this reason, various details of its arrangement and operation have not been given because they are believed to be obvious and well known to those skilled in the art. In accordance with the invention, a restraining device is provided for retaining the motor 12 in a plurality of predetermined steering conditions and that facilitates tilting the motor 12 about a generally horizontal tilt and trim axis 22 extending through a shaft 23 of the swivel bracket 20 while the motor 12 is retained in a predetermined steering condition. As normally employed, the restraining device will releasably retain the motor 12 in any of a plurality of conditions that the associated boat 10 is propelled such as in a straight ahead or turning direction without any change in its travel course.

The device provides a drag friction arrangement that permits the operator to readjust the condition of the motor 12 relative to the boat 10 from one fixed position to another. This is accomplished by reducing the frictional drag between two interengaging locking elements to allow rotation of one locking element relative to the other, applying a force to the tiller 44 to readjust the position of the motor 12 and then increasing the frictional drag between the interengaging locking elements to a level sufficient to hold the motor 12 in its desired position. Thus, the restraining device can be easily released to allow the operator to steer the motor 12 without any frictional drag from the restraining device or easily locked in a non-adjustable condition.

Figure 3:
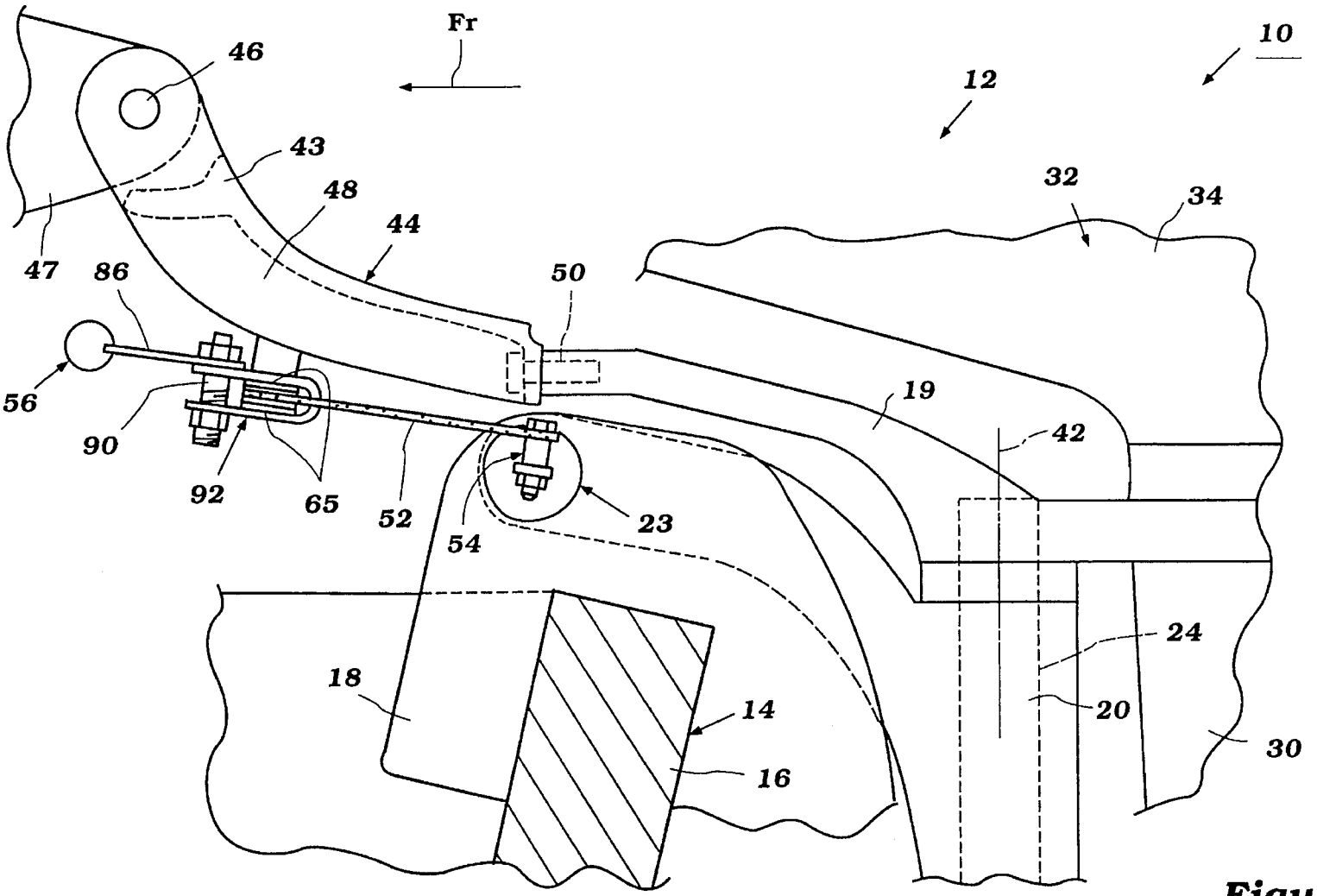
FIG. 3 is an enlarged, side elevational view of the restraining mechanism.

As shown in FIGS. 2 and 3, the restraining device includes a flat, C-shaped friction plate or track 52 secured to a detachable mounting component, generally identified by numeral 54. The friction plate 52 is a textured or surfaced treated plate that is frictionally engaged by a compression adjustment mechanism, generally identified by numeral 56, mounted to the tiller 44. As the tiller 44 is rotated about the steering axis 42, the compression adjustment mechanism 56 traces a semi-circular path that is defined by the C-shaped arc of the friction plate 52 and/or a radius extending from the axis 42 to the compression adjustment mechanism 56.

Figure 4:
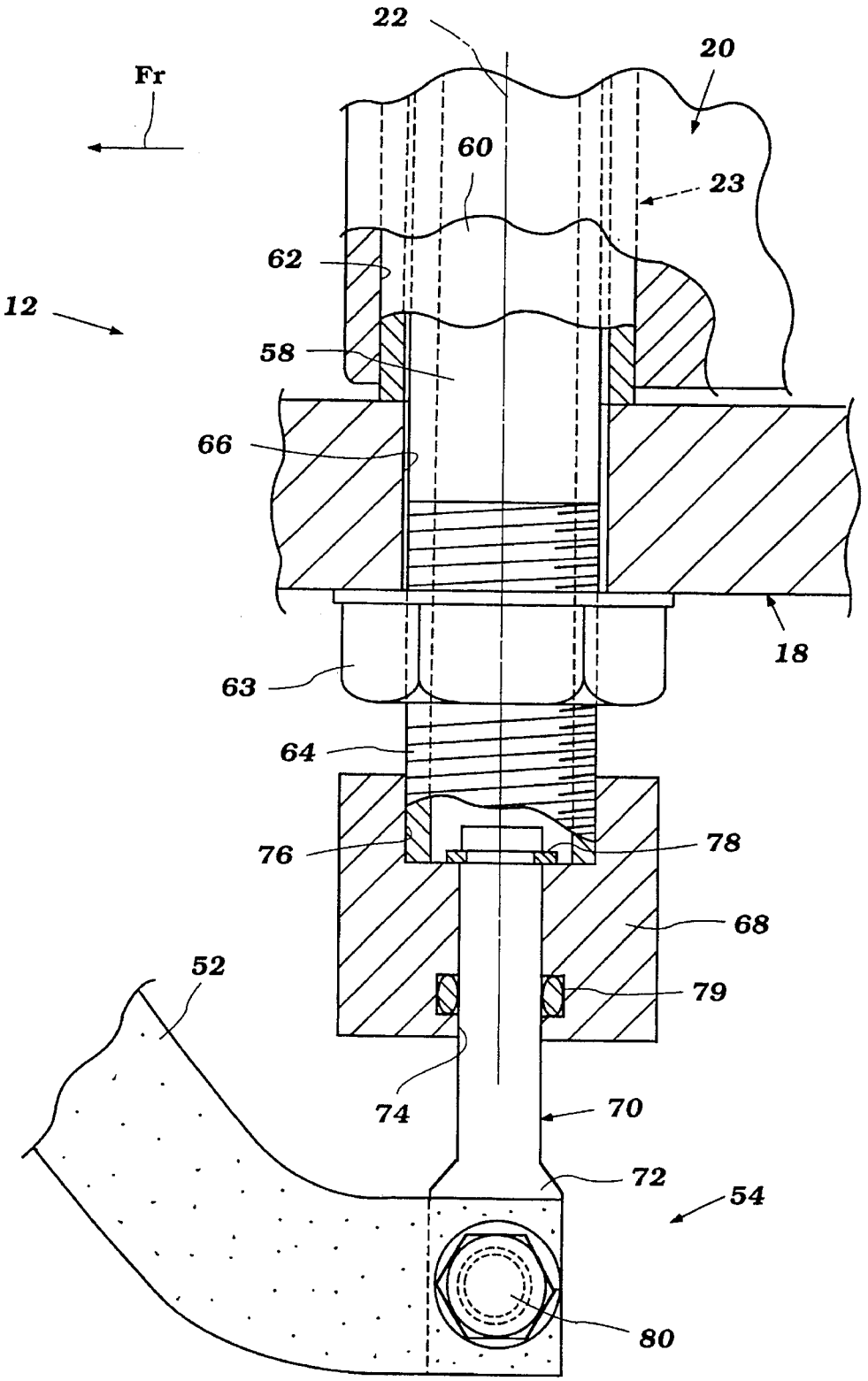
FIG. 4 is an enlarged, top plan view of a friction plate mounting component and swivel assembly employed in the illustrated embodiment.
Figure 5:
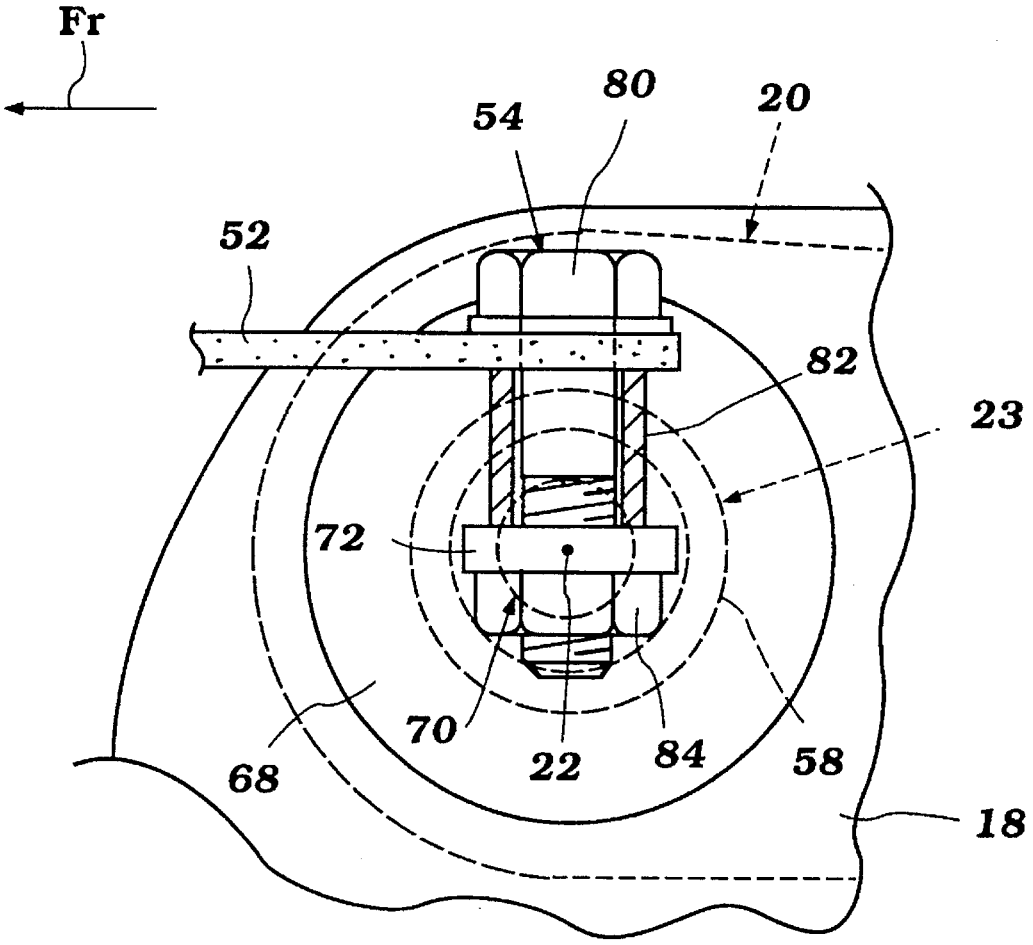
FIG. 5 is an enlarged, side elevational view of the friction plate mounting component.

As shown in FIGS. 4 and 5, the friction plate 52 is secured to a clamping bracket 18 along a generally horizontally extending tilt and trim axis 22 by the pair of mounting components 54 and mounted in such a way so as to permit it to pivot with the swivel bracket 20 upon tilt and trim movement. The tilt axis 22 is generally defined by a centerline through the shaft 23 housing a cylindrical pipe 58 that extends substantially horizontally through a collar 60 fitted inside a bore 62 through the swivel bracket 20. The end of the pipe 58 includes a threaded female screw 64 that further extends through a bore 66 of the clamping or support brackets 18 and is secured thereon by a nut 63.

The mounting components 54 include a detachable mounting nut 68, the threaded female screw 64 formed at the end of the cylindrical pipe 58, and a cylindrical support shaft 70 having a flat portion 72 at one end. The mounting nut 68 provides a through hole 74, 76 containing a larger diameter opening 76 on one end that removably receives and secures the threaded female screw 64, and a smaller diameter opening 74 on an opposite end that slidably receives the cylindrical support shaft 70. The support shaft 70 extends through the nut 68 into the female screw 64 and is secured therein by a snap ring 78. An 0-ring 79 seals the mid-portion of the support shaft 70 and provides a frictional drag between the nut 68 and the shaft 70. Thus, the nut 68 is removably threaded to the female screw 64, but permits rotation of the support shaft 70. A bolt 80 passes through the friction plate 52, a collar 82, and the flat portion 72 and secures the friction plate 52 to the flat portion 72 with a nut 84. Thus, the mounting components 54 permit the friction plate 52 and the swivel bracket 20 to rotate simultaneously about the tilt axis 22 when the tiller 44 is tilted or pivoted about that axis.

Figure 6:
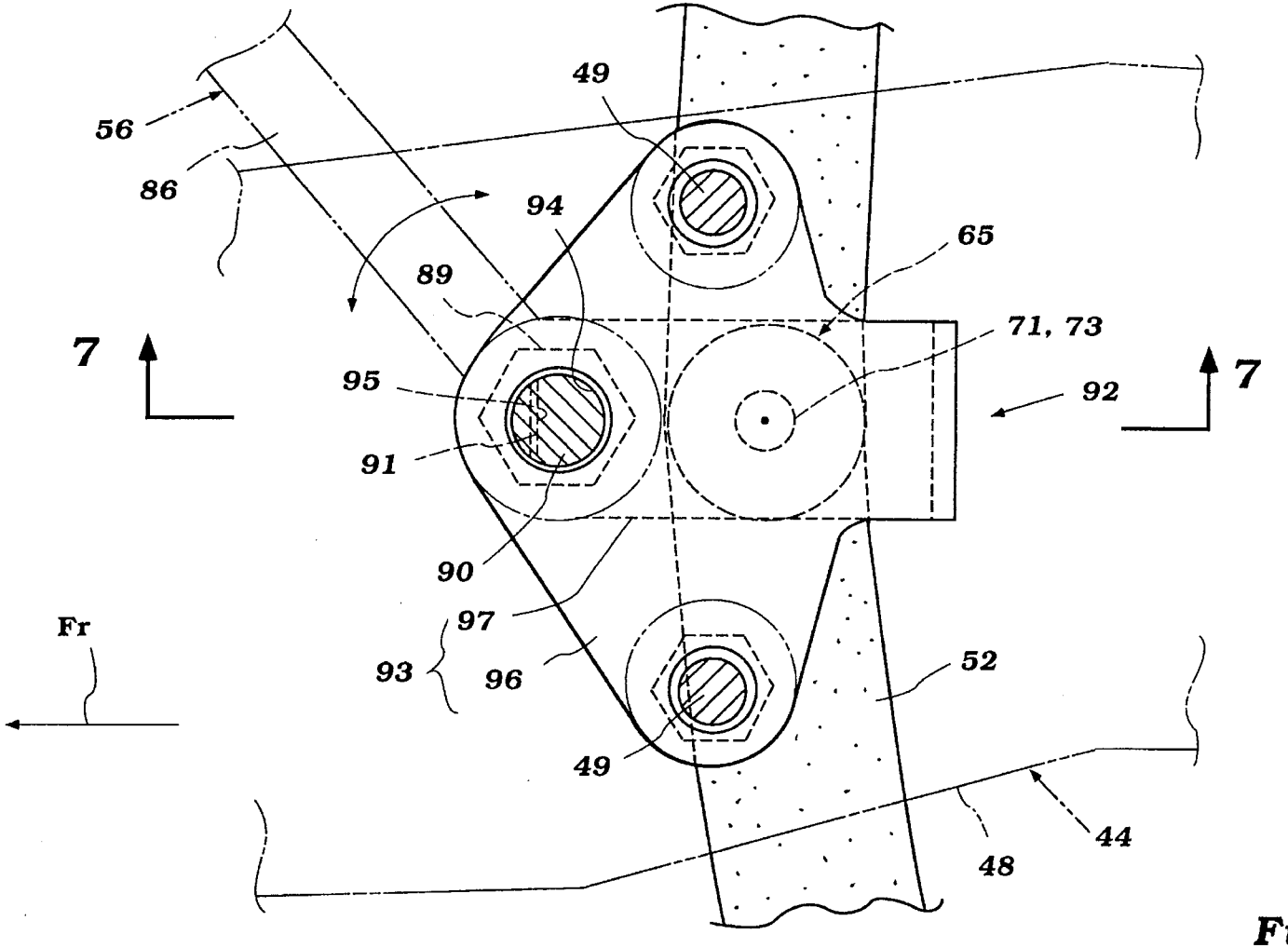
FIG. 6 is an enlarged, top plan view of the restraining mechanism employed in the illustrated embodiment.
Figure 7:
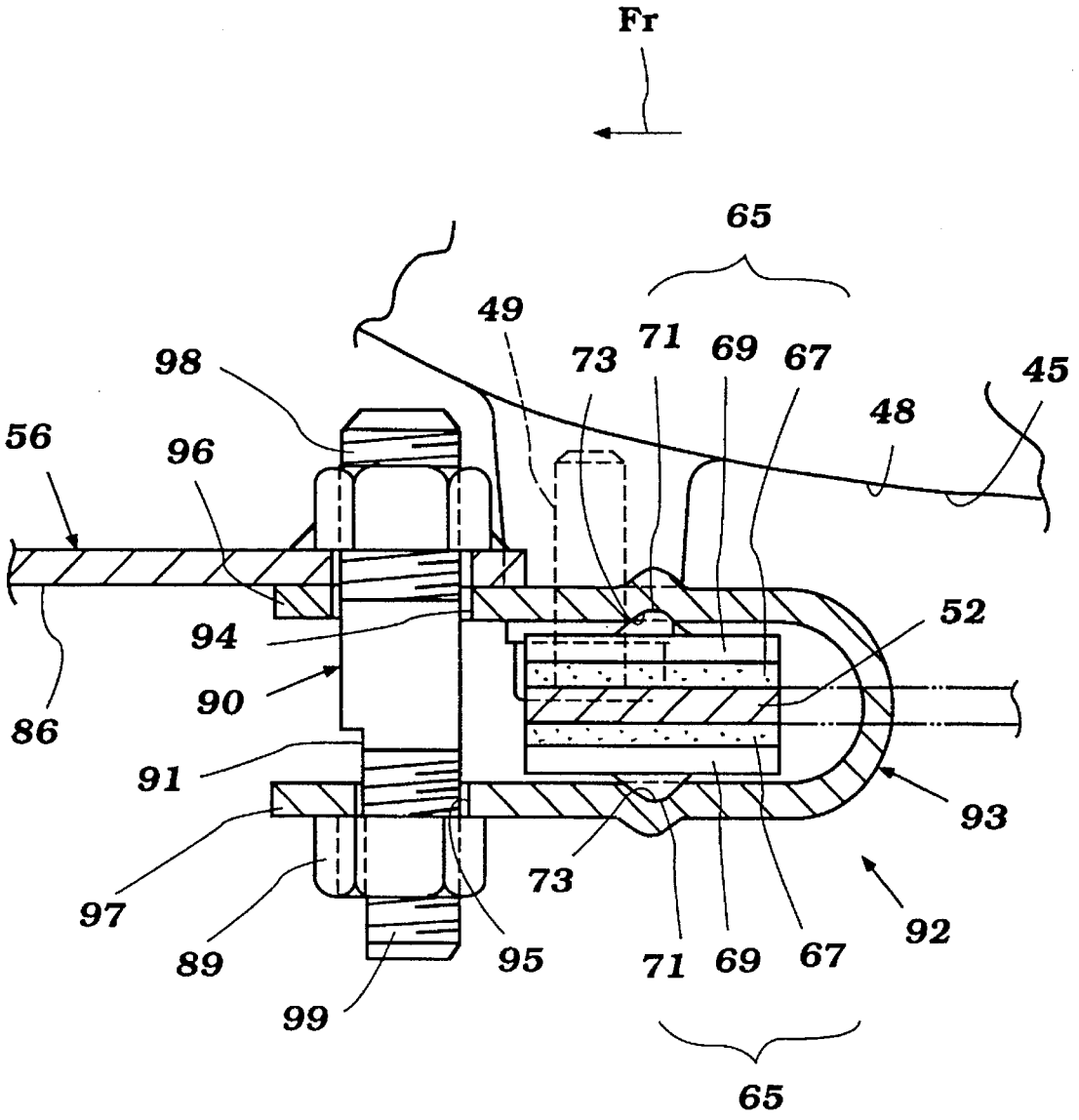
FIG. 7 is an enlarged, cross-sectional view along lines 7—7 of FIG. 6 showing the restraining mechanism in an engaged position.

As shown in FIG. 7, the compression adjustment mechanism 56 includes a handle and knob configuration 86 welded to a nut 88 that tightens and releases about a bolt 90 to compress a frictional stop member 92 into frictional engagement with the plate 52. The bolt 90 passes through a cylindrical through hole 94 in an upper generally triangularly shaped leg 96 (FIG. 6) of a flat, horseshoe-shaped spring component 93 which is fixed to the underside 45 of the tiller extension member 48 by screws 49 and a semi-circular through hole 95 in a lower, generally rectangularly shaped leg 97 of the spring 93. The lower leg 97 extends from the upper leg 96 and curves around the frictional plate 52. The bolt 90 is secured on its upper circular threaded end 98 by the nut 88 and on its lower semi-circular end 99 containing a flat face 91 by a nut 89. Thus, the flat face 91 prevents the bolt 90 from rotating, and thereby allows the nut 88 to compress or flex the lower leg 97 towards the upper leg 96 upon rotation of the nut 88 in a tightening direction. The spring 93 contains sufficient resilience to return to a released position upon rotation of the nut 88 in the opposite direction.

The upper and lower legs 96, 97, respectively, support an upper and lower elastic disc shaped frictional stop pad 65. The upper and lower pads 65 each include a disc-shaped friction pad 67 bonded to respective disc-shaped backing plates 69. A centrally located projecting lug 71 is formed on the top of the backing plate 69 and is received in a complementary recess portion 73 in the upper and lower legs 96, 97 of the spring 93, allowing the pads 65 to pivot slightly therein. The stop pads 65 coordinate to clamp or sandwich the friction track 52 when the compression adjustment mechanism 56 is in an engaged position, such as shown in FIG. 7.

If the operator desires to retain the motor 12 in a particular straight-ahead or turning position, he may engage the restraining device by turning the handle 86 on the compression adjustment mechanism 56 (as shown by the phantom lines in FIG. 2) a sufficient distance to compress the spring 93, and thereby cause the pair of frictional stop pads 65 to clamp about or engage the friction plate 52 (FIG. 7). This will hold the motor 12, and specifically the power head 32 and drive shaft housing 30, against steering rotation about the shaft 24 under normal loadings due to engine vibration and water resistance when traveling in a straight ahead or turning direction.

It should, therefore, be readily apparent from the foregoing description that the described device conveniently permits a motor to be retained in a plurality of different steering positions without the operator maintaining his hand on the tiller. Moreover, the device conveniently permits the operator to readjust the motor from an initial retained steering direction to a plurality of other retained steering directions by releasing the retaining mechanism and applying a horizontal force to the tiller.

Moreover, it should be readily apparent from the foregoing description that the device is designed to allow the friction plate 52 to rotate with the swivel bracket 20 about the tilt axis 22; for example, when the motor 12 is rotated out of the water, and while the retaining device is still in an engaged or unengaged position. While embodiments and applications of this invention have been shown and described, it would be apparent to those skilled in the art that many more modifications are possible without departing from the inventive concepts herein. The invention, therefore, is not to be restricted except in the spirit of the appended claims.

I claim:

1. An outboard motor comprising a swivel bracket adapted to be affixed to a vessel for pivotal movement about a horizontally extending trim axis, a propulsion unit journaled for steering movement about a steering axis by said swivel bracket and for pivotal movement about said tilt axis with said swivel bracket, a tiller affixed to said propulsion unit and extending forwardly therefrom across said tilt axis for steering of said propulsion unit about said steering axis, a control handle pivotally supported at the forward end of said tiller for pivotal movement about a generally horizontally extending axis between a forwardly extending control position and an upwardly extending storage position, a steering locking mechanism for selectively holding said propulsion unit against steering movement relative to said swivel bracket while permitting pivotal movement of said swivel bracket and said propulsion unit about said trim axis comprising a pair of selectively interengageable frictional locking elements, one carried by said tiller for rotation about said steering axis and comprised of a pair of spaced apart frictional members and the other pivotal about said trim axis for following said one element upon pivotal movement about said trim axis and being interposed between said pair of spaced apart frictional members throughout their range of movement upon motion of said tiller about said steering axis.

2. An outboard motor as set forth in claim 1, wherein the selectively interengageable locking elements include a manually operated release mechanism pivotal about an axis through less than 360° between a first, released position wherein said frictional members are spaced from said other element and a second, engaged position wherein said other element is frictionally clamped between said frictional members.

3. An outboard motor as set forth in claim 2, wherein the other of the locking elements is positioned in the steering path of the propulsion unit and the one locking element frictional members for selective engagement with said frictional members at all locations along said path.

4. An outboard motor as set forth in claim 3, wherein the other element comprises an arcuate plate extending along an arc defined by a radius extending from the steering axis of the propulsion unit and the one frictional element comprises a frictional clamp selectively engageable with said plate in all positions along said arc.

5. The outboard motor as set forth in claim 4, wherein the frictional members comprise a pair of frictional pads mounted on opposite ends of a C-shaped spring, said spring being deflected upon operation of the manual release mechanism to its locking position and effecting release of the frictional pads tip upon movement of the release mechanism to its released position.

6. The outboard motor of claim 1, wherein the other locking element is detachably connected to the ends of a pivot pin which defines the trim axis.

7. The outboard motor of claim 6, wherein the detachable connection to the trim pivot pin is provided by a pair of screw connections.

* * * * *